US007815229B2

(12) United States Patent
Ooe et al.

(10) Patent No.: US 7,815,229 B2
(45) Date of Patent: Oct. 19, 2010

(54) DOOR OPENING AND CLOSING APPARATUS FOR VEHICLE

(75) Inventors: Kouji Ooe, Kariya (JP); Yoshitaka Kato, Toyota (JP); Keisuke Matsumoto, Anjo (JP); Satoshi Takeno, Hazu-gun (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 47 days.

(21) Appl. No.: 11/948,106

(22) Filed: Nov. 30, 2007

(65) Prior Publication Data

US 2008/0136195 A1 Jun. 12, 2008

(30) Foreign Application Priority Data

Dec. 7, 2006 (JP) ..... 2006-330483

(51) Int. Cl.
*E05C 3/06* (2006.01)

(52) U.S. Cl. ..... 292/198; 292/DIG. 23; 292/216; 292/201

(58) Field of Classification Search ..... 292/198, 292/216, 201, DIG. 23
See application file for complete search history.

(56) References Cited

U.S. PATENT DOCUMENTS 5,676,003 A * 10/1997 Ursel et al. ..... 70/472
5,715,713 A * 2/1998 Aubry et al. ..... 70/277
5,803,515 A * 9/1998 Arabia et al. ..... 292/216
5,997,055 A * 12/1999 Strathmann ..... 292/201
6,079,757 A * 6/2000 Aubry ..... 292/201
6,126,212 A * 10/2000 Fujihara ..... 292/216
6,406,073 B1 * 6/2002 Watanabe ..... 292/216
6,419,286 B1 * 7/2002 Szablewski ..... 292/216
6,607,222 B2 * 8/2003 Inoue ..... 292/216
6,722,714 B2 * 4/2004 Ooe et al. ..... 292/216
6,955,389 B2 * 10/2005 Suzuki et al. ..... 296/146.4
7,021,681 B2 4/2006 Hayakawa et al.
7,222,459 B2 * 5/2007 Taniyama ..... 49/280

FOREIGN PATENT DOCUMENTS

JP 2001-182401 A 7/2001
JP 2004-044360 A 2/2004

* cited by examiner

*Primary Examiner*—Carlos Lugo
*Assistant Examiner*—Mark Williams
(74) *Attorney, Agent, or Firm*—Buchanan Ingersoll & Rooney PC

(57) ABSTRACT

A door opening and closing apparatus for a vehicle includes a latch unit holding a vehicle door in a closed state, a lift lever operatively connected to the latch unit, an open lever operatively connected to the lift lever, a locking lever switching a locking knob between a locked stated and an unlocked state, the locking lever including a first lever connected to the open lever and a second lever connected to the first lever for relative rotation with a predetermined angle, the second lever operated by a locking actuator, a biasing member disposed between the first lever and the second lever to bias the second lever in a direction of an original position, and an outside lever including an outside handle lever connected to the outside handle and a release lever connected to the lift lever and operated by a release actuator.

17 Claims, 6 Drawing Sheets

DOOR OPENING AND CLOSING APPARATUS FOR VEHICLE

CROSS REFERENCE TO RELATED APPLICATIONS

This application is based on and claims priority under 35 U.S.C §119 with respect to Japanese Patent Application 2006-330483, filed on Dec. 7, 2006, the entire content of which is incorporated herein by reference.

FIELD OF THE INVENTION

This invention relates to a door opening and closing apparatus for a vehicle. In particular, the invention relates to a door opening and closing apparatus for a vehicle, which properly opens a vehicle door by operating an outside handle.

BACKGROUND

A slide door opening and closing apparatus for a vehicle including a power slide door device is disclosed in JP 2001-182401A. The slide door opening and closing apparatus is provided with a latch unit holding a vehicle slide door in a closed state relative to a vehicle body and a locking actuator used for releasing the latch unit.

In this type of slide door opening and closing apparatus for a vehicle, when the user tries to open the slide door of the locked vehicle, the locked state of the driver's seat is released by a first operation conducted by using a remote controller. The locked state of the other seats is released by a second operation conducted by using the remote controller. In the state, an outside handle of the slide door is operated to activate the power slide door device, and the slide door is automatically opened.

However, if the user would like to open the slide door quickly and operates the outside handle prematurely, an open lever connecting to an outside handle is operated before a locking knob is moved to an unlocked position in response to the operation of the locking lever conducted by the locking actuator. Thus, a slide bush, which engages with an arc-shaped elongated hole and a recessed portion radially extending from the arc-shaped elongated hole, comes in contact with a sidewall of the arc-shaped elongated hole, leading to inability of the locking actuator to unlock.

As a result, a so-called panic state, in which the door to be opened remains locked when the other doors are unlocked, is caused. In order to resolve the panic state, the user has to release his/her hand from the outside handle and brings all of the unlocked doors into the locked state again. Then, the operation of the outside handle has to be reattempted.

Technology, which is meant to resolve the panic state, is disclosed in JP 2004-44360A. According to the disclosure of JP 2004-44360A, a locking lever (lock lever) is composed of a main lever, a sub lever and a spring. The main lever and the sub lever are rotatable relative to each other, and the spring is disposed between the main lever and the sub lever. Even if the outside handle and the like are operated concurrently with the operation of the locking actuator and the like in the locked state, the locked state is switched to the unlocked state by returning the outside handle and the like to the original position. Hence, the second switching operation to the unlocked state becomes unnecessary, and thus reducing complexity of the operation.

If a vehicle adopts a so-called smart entry system (keyless entry system), which is a communicating door opening and closing system, a vehicle's owner (hereinafter, referred to as the user) approaching the vehicle is authenticated by wireless transmission of a portable unit, and the approach of the user's hand to the door handle is detected to switch the locked state of the vehicle slide door to the unlocked state. In the case that the smart entry system includes a power slide door device, normally, an open lever, which is rotated by the operation of the outside handle, is connected to a release actuator. Thus, even if the outside handle is not operated, the open lever is operated by operating the release actuator. Further, in the smart entry system, it is expected that the latch is brought to the unlatched state by operating the release actuator, regardless of whether the locking knob is in the locked state or not.

Namely, in the apparatus disclosed in JP 2004-44360A, as shown in FIG. 3, two arc-shaped elongated holes are defined at an open lever. A cable, which is connected to an outside handle of an outside handle unit, is slidably engaged with one of the arc-shaped elongated holes. Further, not shown in FIG. 3, a cable (not shown), which is connected to the release actuator, is slidably engaged with the other elongated hole.

However, the panic state is still unsolved in this structure. For example, when a passenger tries to get in the vehicle from a rear slide door and operates the door handle before the vehicle door is switched from the locked state to the unlocked state, assuming that the door has been unlocked, similarly to the above-described example, the rear slide door is not opened (the latch is not released). Further, even if the release actuator is operated with the outside handle pulled, the cable connected to the release actuator is simply slid relative to the arc-shaped elongated hole and the open lever is not operated. Thus, the latch is not released. In order to release the latch, the release actuator has to be operated after the outside handle is returned to the original position and the switching operation of the locking knob to the unlocked state is conducted.

Thus, even in the door locking apparatus disclosed in JP 2004-44360A, when the outside handle is operated before the locking knob is switched to the unlocked state, the user has to return the outside handle and switch the locking knob from the locked state to the unlocked state. Then, the door is opened (the latch is released) by operating the release actuator.

A need exists for a door opening and closing apparatus for a vehicle which is not susceptible to the drawback mentioned above.

SUMMARY OF THE INVENTION

According to an aspect of the present invention, a door opening and closing apparatus for a vehicle includes a latch unit holding a vehicle door in a closed state relative to a vehicle body, a lift lever connected to the latch unit to operate the latch unit, an open lever operatively connected to the lift lever, a locking lever switching a locking knob between a locked stated and an unlocked state, the locking lever including a first lever connected to the open lever and a second lever connected to the first lever for relative rotation with a predetermined angle, the second lever operated by a locking actuator, a biasing member disposed between the first lever and the second lever to bias the second lever in a direction of an original position where the second lever is placed before rotating relative to the first lever, and an outside lever including an outside handle lever connected to the outside handle and a release lever connected to the lift lever and operated by a release actuator.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Hereinafter, an embodiment of a door opening and closing apparatus for a vehicle 10 will be described with reference to drawings. A power slide door device mounted at a so-called smart entry system (keyless entry system) is described in the embodiment. The smart entry system is a communicating door opening and closing system, which authenticates a user approaching the vehicle by wireless transmission from a user's portable unit (smart key) of the vehicle and detects that the user moves his/her hand to the door handle to switch the vehicle door from a locked state to an unlocked state.

Figure 1:
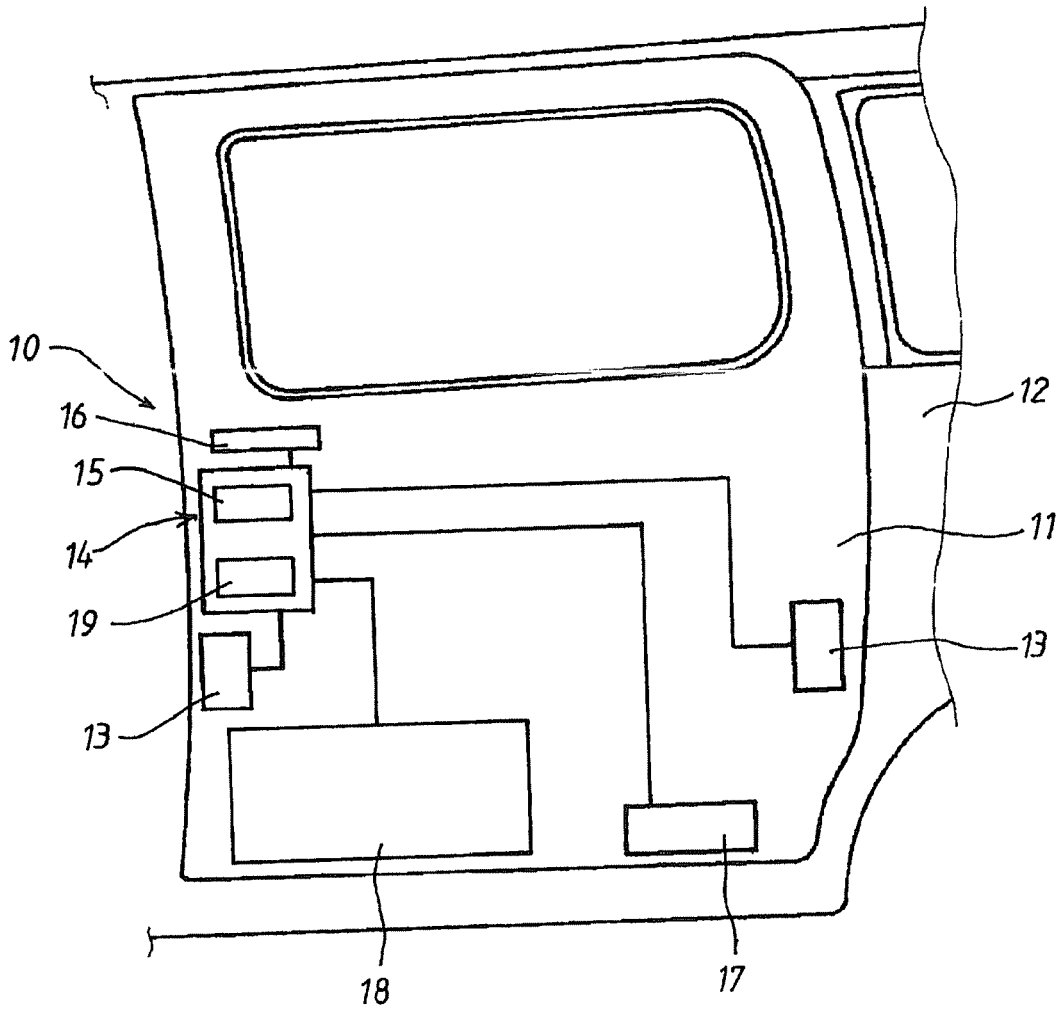
FIG. 1 is a front view illustrating a door opening and closing apparatus for a vehicle according to an embodiment of the invention.

In FIG. 1, a pair of latch units 13, a remote control unit 14, an inside handle unit 15, an outside handle unit 16, a fully opened door locking unit 17 and a power slide door device 18 are disposed in a vehicle slide door 11. The latch units 13 are respectively disposed at forward and backward sides of the slide door 11 and hold a closed state of the slide door 11 relative to a vehicle body 12. The remote control unit 14 operates the latch unit 13, and the inside handle unit 15 and the outside handle unit 16 operate the remote control unit 14. The fully opened door locking unit 17 holds an open state of the vehicle door 11 relative to the vehicle body 12, and the power slide door device 18 opens and closes the slide door 11 automatically. The remote control unit 14 is provided with a release actuator 19 and the like.

The latch unit 13 consists of a well-know structure having a rotatable latch engaged with or disengaged from a striker of the vehicle body 12 and a rotatable pawl restricting rotation of the latch by engaging with the latch. Further, the inside handle unit 15 consists of a well-known structure having an inside handle pivotably supported by a handle base. Furthermore, the fully opened door locking unit 17 consists of a well-known structure having a rotatable hook engaged with or disengaged from an engaging pill of the vehicle body 12. Since the structures of the units are well-known, details will be omitted here.

The connection is electrically or mechanically established between the remote control unit 14 and the pair of the latch units 13 which are respectively disposed at forward and backward sides of the slide door 11, between the outside handle unit 16 and the remote control unit 14, and between the power slide door device 18 and the remote control unit 14 and the like via cables or rods disposed at the slide door 11.

Figure 2:
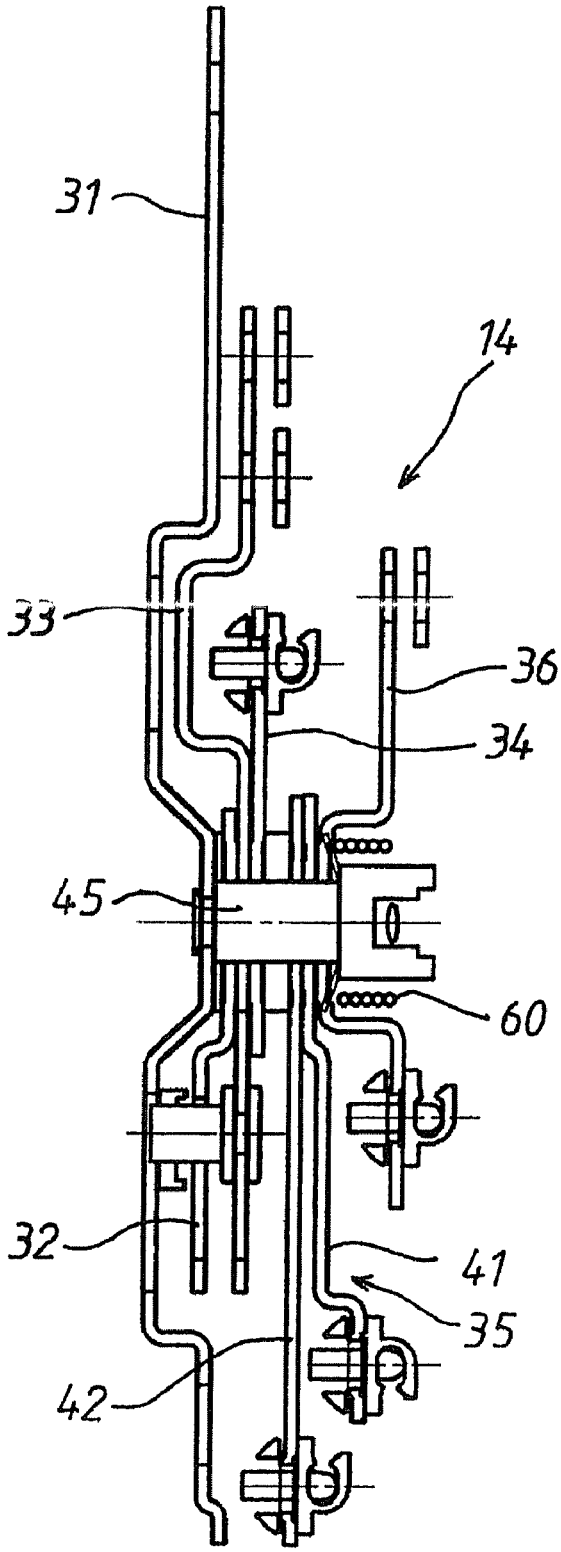
FIG. 2 is a sectional view of the door opening and closing apparatus for the vehicle.
Figure 3:
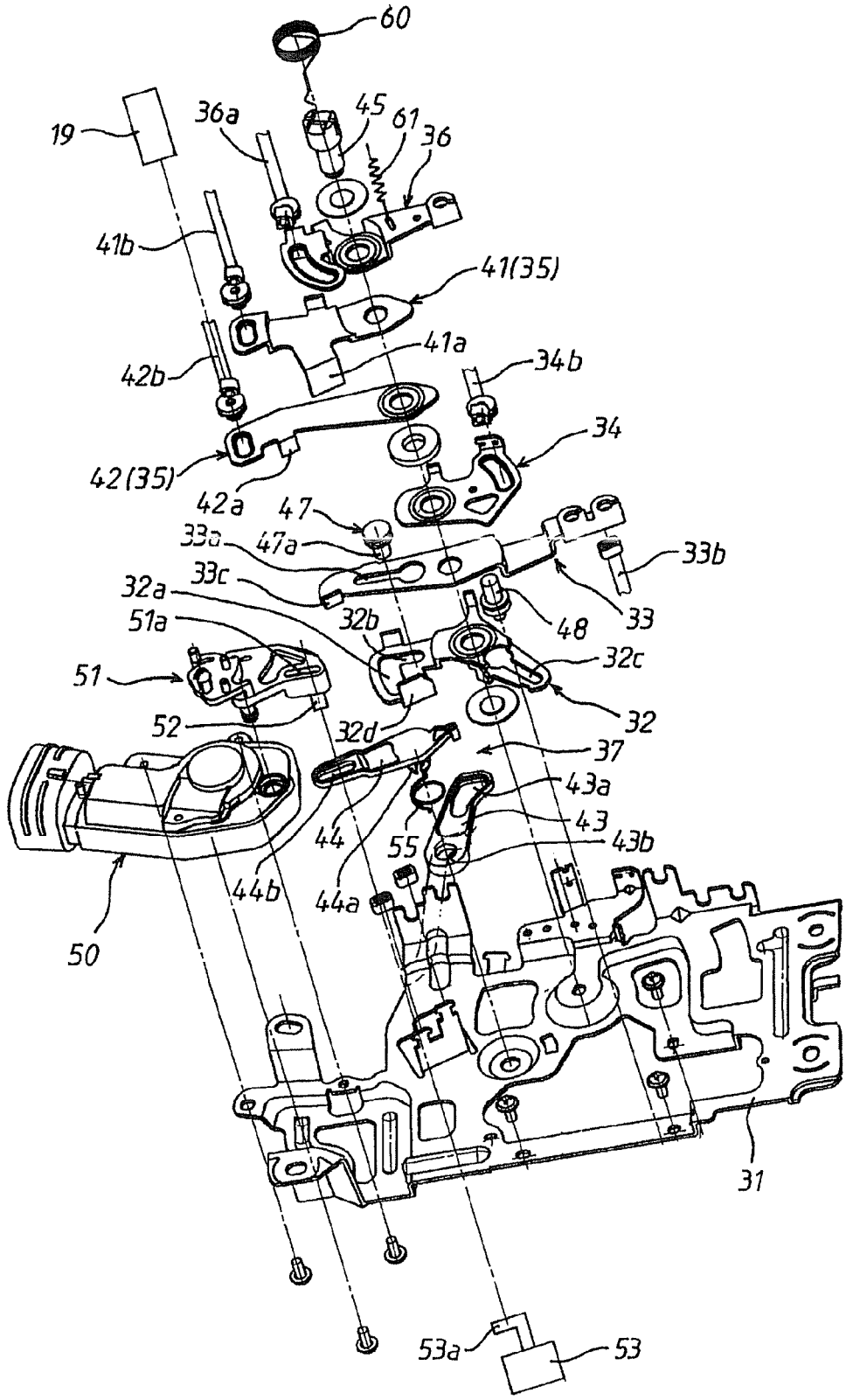
FIG. 3 is an exploded perspective view of the door opening and closing apparatus for the vehicle.

As shown in FIGS. 2 and 3, the remote control unit 14 includes a base bracket 31, an open lever 32, a lift lever 33, an inside lever 34, an outside lever 35, a fully opened door locking lever 36 and a locking lever 37. The remote control unit 14 is disposed at a compartment side of a door inner panel of the slide door 11 and is covered with an interior trim (not shown) mounted on the door inner panel.

Figure 4:
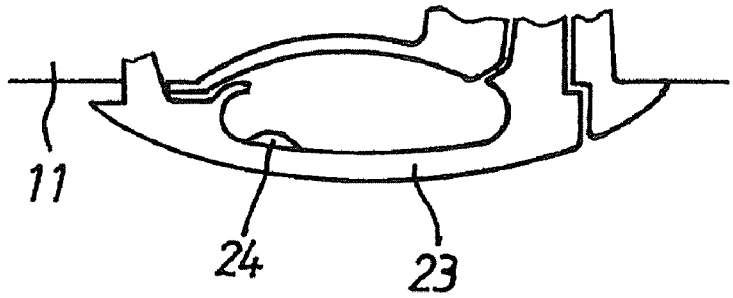
FIG. 4 is a schematic view of an outside handle.

As shown in FIG. 4, the outside handle unit 16 is provided with a swingable outside handle 23, and the outside handle 23 is disposed on an outer surface of an edge portion of the slide door 11, which is located closer to a door closing direction. A switch 24 is provided at an inside of the outside handle 23 to be operated when the user grips the outside handle 23. The inside handle unit 15 is provided with an inside handle (not shown) provided at the inside of the slide door 11, a fully opened door locking handle, and a locking knob 53, which will be described later.

When the user of the vehicle having the portable unit (smart key) approaches an area within a certain distance from the locked vehicle, the vehicle authenticates the user by identifying an ID signal wirelessly transmitted from the portable unit. Thereafter, if the user grips the outside handle 23 and operates the switch 24 for opening the slide door 11, the locked state of all doors is released and the slide door 11 becomes openable.

The outside lever 35 is composed of two components, i.e. an outside handle lever 41 and a release lever 42. The outside handle lever 41 is operated by operating the outside handle 23 and the release lever 42 is operated by the release actuator 19. Also, the locking lever 37 is composed of two components, i.e. a first lever 43 and a second lever 44. The first lever 33 is rotatable relative to the second lever 44 at a predetermined angle.

A coaxial shaft 45 is fixedly attached to the base bracket 31 by riveting. The open lever 32, the lift lever 33, the inside lever 34, the outside handle lever 41, the release lever 42 and the fully opened door locking lever 36 are rotatably supported by the coaxial shaft 45. The outside handle lever 41 and the release lever 42 compose the outside lever 35.

The lift lever 33 is rotatably supported by the coaxial shaft 45 at its almost longitudinally middle portion, and an end of the lift lever 33 is connected to the latch unit 13 via a cable 33*b*. An elongated hole 33*a* is formed extending in a radial direction of the coaxial shaft 45, and a slide bush 47 engages with the radial elongated hole 33*a* so as to slide therealong.

The open lever 32 is rotatably supported by the coaxial shaft 45 at its nearly middle portion. An end of the open lever 32 is provided with an arc-shaped elongated hole 32*a* defined around the coaxial shaft 45 and is further provided with a recessed portion 32*b* extending continuously from the arc-shaped elongated hole 32*a* in the radial direction thereof. An engagement pin 47*a* of the slide bush 47 penetrates through the arc-shaped elongated hole 32*a* and the recessed portion 32*b* so as to slidably engage therewith. The other end of the open lever 32 is provided with an elongated hole 32*c* extending radially, and an engaging pin 48 slidably engages with the elongated hole 32*c*. The engaging pin 48 is connected to a child lock lever (not shown) provided at the inside handle unit 15.

The child lock lever consists of a well-know structure which prevents the operation of the latch unit 13 even when the inside handle lever 34 is operated. Since the structure is well known, details are omitted here.

The outside handle lever 41 and the release lever 42, which compose the outside lever 35, are rotatably supported by the coaxial shaft 45 at each end so as to rotate independently. The other end of the outside handle lever 41 is connected to the outside handle 17 via a cable 41*b*. An engaging flange 41*a* (third engaging flange) is formed in the outside handle lever 41 to engage with an engaging flange 32*d* (fourth engaging flange) formed at the open lever 32 for rotating the open lever 32 unitarily with the outside handle lever 41 when the outside handle lever 41 rotates in one direction.

On the other hand, the other end of the release lever 42 is connected to the release actuator 19 via a cable 42*b* and the release actuator 19 is operated in conjunction with the operation of the power slide door device 18. An engaging flange 42*a* (first engaging flange) is formed at the release lever 42 to engage with an engaging flange 33*c* (second engaging flange) formed at the lift lever 33 for rotating the lift lever 33 unitarily with the release lever 42 when the release lever 42 rotates in one direction. Hence, the lift lever 33 is directly rotated in conjunction with the rotation of the release lever 42 caused by the release actuator 19.

The inside lever 34 is rotatably supported by the coaxial shaft 45 at one end thereof, and the other end of the inside lever 34 is connected to the inside handle (not shown) of the inside handle unit 15 via a cable 34*b*. The lift lever 33 is operated by rotating the inside lever 34 via the open lever 32.

The locking lever 37 is composed of the first lever 43 and the second lever 44. The first lever 43 and the second lever 42 rotate about an axial portion 44*a* relative to each other. The axial portion 44*a* is formed at one end of the second lever 44 to penetrate through a penetrated hole defined around a rotation center of the first lever 43 and is rotatably supported by the base bracket 31. The axial portion 44*a* is supported by the base bracket 31 so as to rotate about an axial center, which is spaced a predetermined distance in a direction perpendicular to an axis line relative to the coaxial shaft 45. The first lever 43 is formed with an arc-shaped elongated hole 43*a* defined around the coaxial shaft 45. The engagement pin 47*a* of the slide bush 47 penetrates through the arc-shaped elongated hole 43*a* to be moved between the arc-shaped elongated hole 32*a* and the recessed portion 32*b*, which are provided at the open lever 32, by rotating the first lever 43.

On the other hand, an elongated hole 44*b* is formed extending in a radial direction at the second lever 44, and an engaging pin 52, which projects at the output lever 51 of the locking actuator 50, is slidably engaged with the elongated hole 44*b*. Thus, when the output lever 51 is rotated by operating the locking actuator 50, the second lever 44 is rotated at the predetermined angle via the engaging pin 52 in conjunction with the rotation of the output lever 51. The locking actuator 50 consists of a well-known structure driven by an electric motor, and is secured to the base bracket 31.

An elongated hole 51*a* is defined at the output lever 51, and an engaging portion 53*a* of the locking knob 53 is engaged with the elongated hole 51*a* so as to slide therealong. The output lever 51 is rotated by the locking actuator 50, and the second lever 44 of the locking lever 37 is rotated in conjunction with the rotation of the output lever 51. Also, the locking knob 53 is moved between an unlocked position and a locked position. The second lever 44 of the locking lever 37 may be rotated by sliding of the locking knob 53 or swing of the locking knob 53 caused by the output lever 51.

Figure 5:
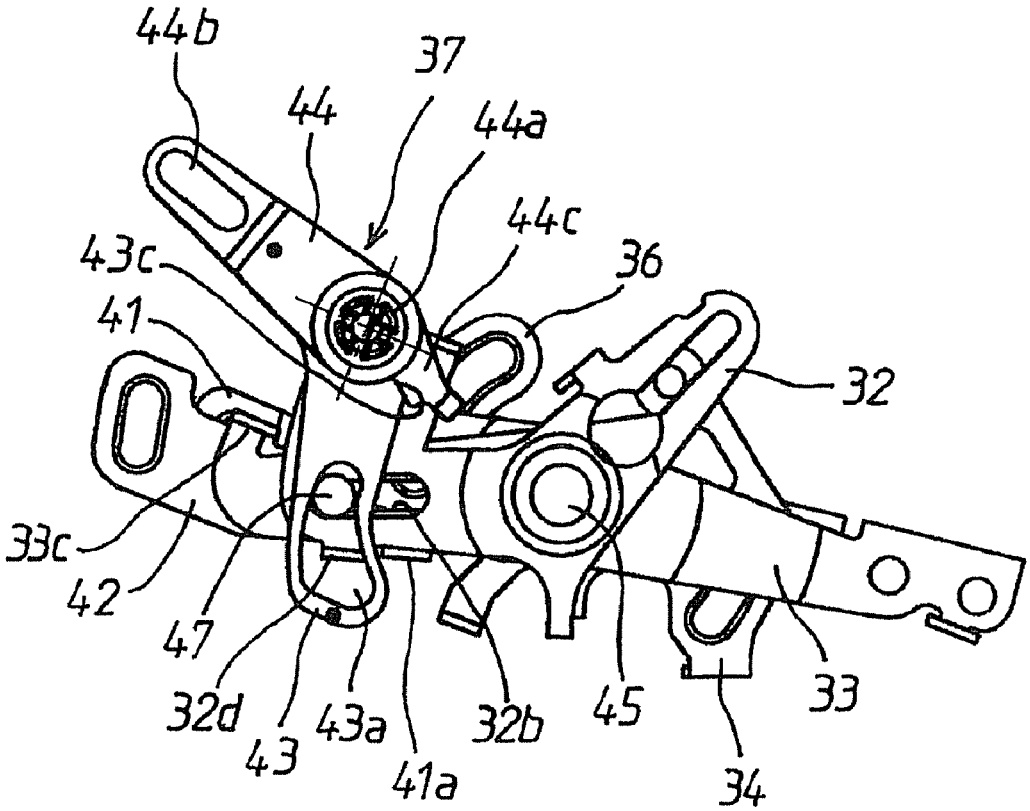
FIG. 5 is an explanatory view illustrating a locked state of the door opening and closing apparatus for the vehicle.
Figure 6:
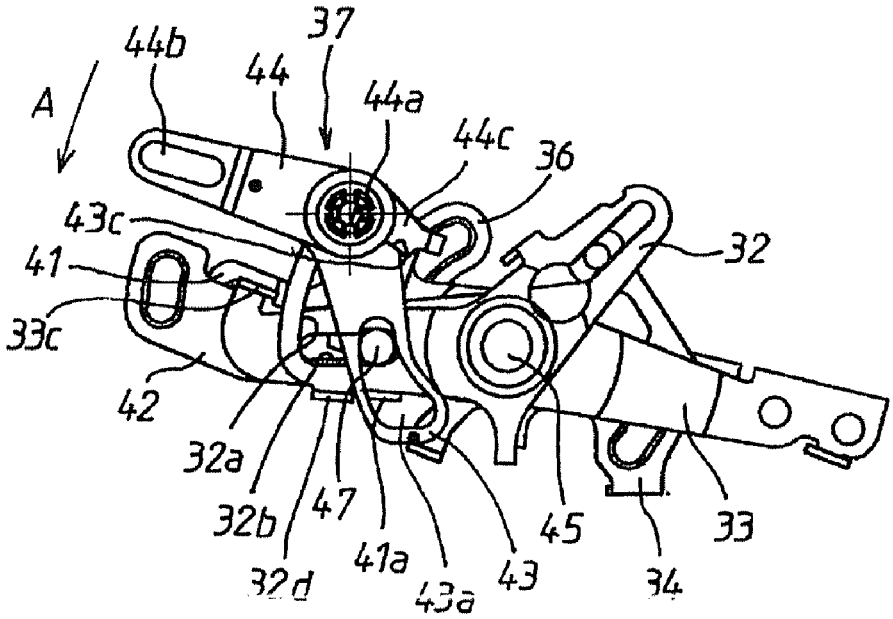
FIG. 6 is an explanatory view illustrating an unlocked state of the door opening and closing apparatus for the vehicle.
Figure 7:
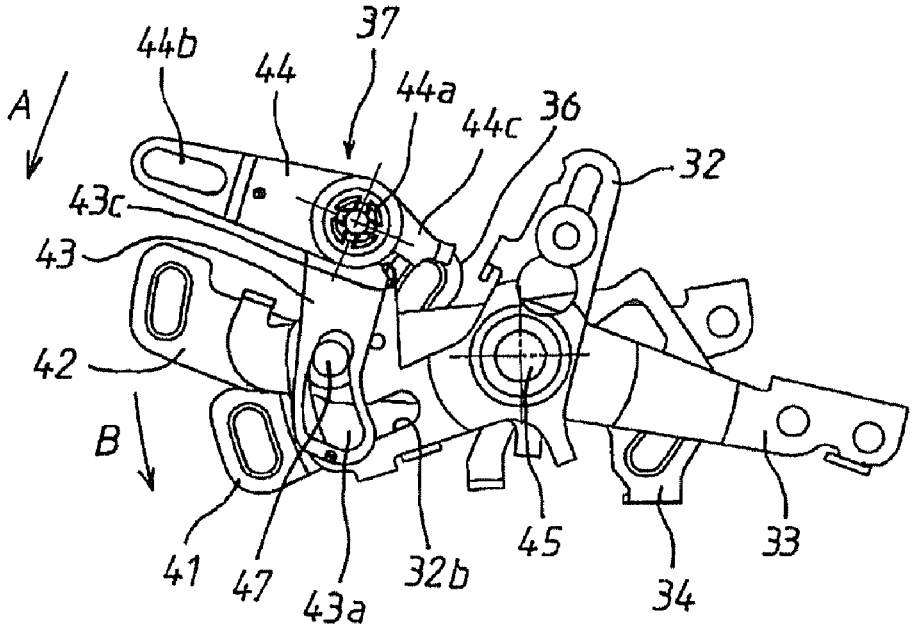
FIG. 7 is an explanatory view illustrating a state that only a lock knob is unlocked.

A torque spring 55 (biasing member) is interposed between the first lever 43 and the second lever 44. The torque spring 55 (biasing member) biases the second lever 44 in a clockwise direction viewed in FIG. 3 around the axial portion 44*a* relative to the first lever 43, and the second lever 44 and the first lever 43 are usually held at the angle that an engaging protrusion 44*c* formed at the second lever 44 engages with an engaging surface 43*c* formed at the first lever 43 as shown in FIGS. 5 and 6. Thus, the second lever 44 rotates at the predetermined angle against the torque spring 55 (biasing member) by the locking actuator 50 with the first lever 43 restricted from rotating (the state is shown in FIG. 7). A stopper mechanism is composed of the engaging surface 43*c* formed at the first lever 43 and the engaging protrusion 44*c* formed at the second lever 44 to hold the first lever 43 and the second lever 44 having the predetermined angle therebetween.

As shown in FIG. 7, the aforementioned structure allows the second lever 44 of the locking lever 37 to rotate relative to the first lever 43 against the torque spring 55 (biasing member) even when the engaging pin 47*a* of the slide bush 47 is inserted into the arc shaped elongated hole 32*a* of the open lever 32 to engage therewith in conjunction with the rotation (direction indicated by the arrow B) of the outside handle lever 41. Hence, the locking knob 53 is unlocked by the locking actuator 50, regardless of the operation states of the open lever 32 and the outside handle lever 41, which are connected to the first lever 43.

The fully opened door locking lever 36 is rotatably supported by the coaxial shaft 45 at its longitudinal almost middle portion. The fully opened door locking lever 36 is connected to the fully opened door locking unit 17 at one end thereof via an cable 36*a* and is also connected to a fully opened door locking handle at the other end thereof via a rod (not shown). Thus, the fully opened door locking lever 36 is rotated by operating the fully opened door locking handle.

A torque spring 60 is disposed around the coaxial shaft 45. One end of the torque spring 60 is engaged with the fully opened door locking lever 36 and the other end thereof is engaged with the coaxial shaft 45. A tension spring 61 is disposed between the fully opened door locking lever 36 and the base bracket 31, and a biasing force of the tension spring 61 rotates the fully opened door locking lever 36 in a counter clockwise direction in FIG. 3 (clockwise direction in FIG. 5) usually to be held at an original position shown in FIG. 5. Further, the outside handle lever 41 and the open lever 32 are positioned at an original position shown in FIG. 5 with the engaging flange 41*a* (third engaging flange) of the outside handle lever 41 contacting with the engaging flange 32*d* (fourth engaging flange) of the open lever 32. Similarly, the release lever 42 and the lift lever 33 are positioned at an original position shown in FIG. 5 with the engaging flange 42*a* (first engaging flange) of the release lever 42 contacting with the engaging flange 33*c* (second engaging flange) of the lift lever 33.

Figure 8:
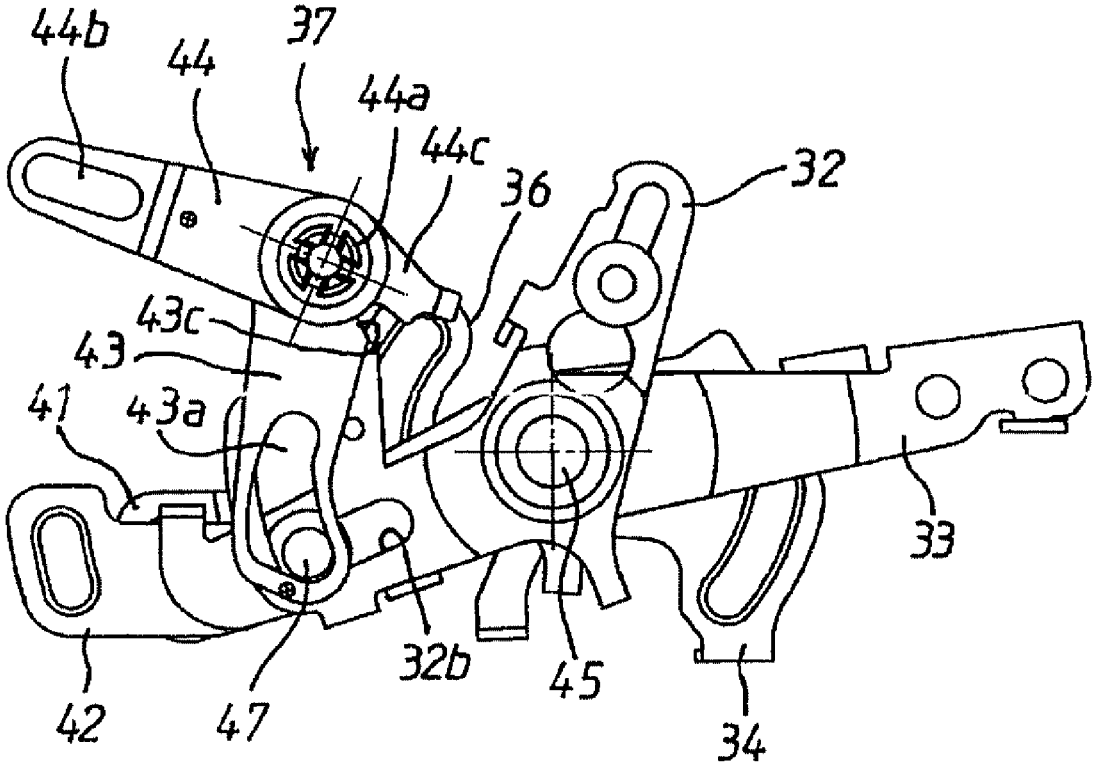
FIG. 8 is an explanatory view illustrating operations of an outside handle lever and a release lever.

Next, the operation of the door opening and closing apparatus 10 for the vehicle will be described. FIGS. 5 to 8 show the operation state of the remote control unit 14. FIG. 5 shows a locked state of the remote control unit 14, FIG. 6 shows an unlocked state of the remote control unit 14, FIG. 7 shows a state that the first lever 43 of the locking lever 37 is prevented from rotating and only the second lever 44 is moved to the unlocked position when the outside handle lever 41 is rotated before the locking knob 53 is unlocked, and FIG. 8 shows a state that the outside handle lever 41 and the release lever 42 are concurrently operated.

In the state that all vehicle doors, including the slide door 11, are locked, when the user having the portable unit (smart key) approaches the area within the certain distance from the locked vehicle, the vehicle authenticates the user by identifying the ID signal wirelessly transmitted from the portable unit. In this state, the switch 24 provided at the outside handle 23 is operated by gripping the outside handle 23 to open the slide door 11. The locking actuator 50 is operated in response to the operation of the switch 24. At this time, if a main switch of the power slide door device 18 provided at the driver's seat is turned off, the release actuator 19 is not operated.

The second lever 44 of the locking lever 37 is rotated about the axial portion 44*a* in a counter clockwise direction in FIG. 6 (direction indicated by the arrow A) and the first lever 43 is unitarily rotated with the second lever 44 in the counter clockwise direction via the torque spring 55 (biasing member). Consequently, the slide bush 47 engaging with the arc shaped elongated hole 43*a* of the first lever 43 is moved from the arc shaped elongated hole 32*a* to the recessed portion 32*b* of the open lever 32, and thereby bringing the remote control unit 14 into the unlocked state.

When the outside handle 23 is operated in this state, the outside handle lever 41 is rotated around the coaxial shaft 45 in a clockwise direction in FIG. 3 (counter clockwise in FIG. 6). Consequently, the open lever 32 is unitarily rotated with the outside handle lever 41 via the engaging flange 41*a* (third engaging flange) and the engaging flange 32*d* (fourth engaging flange), and the lift lever 33 is rotated about the coaxial shaft 45 in the clockwise direction in FIG. 3 (counter clockwise direction in FIG. 6) to release the latch unit 13. Thus, the slide door 11 is manually opened.

Meanwhile, when the user operates the outside handle 23 prematurely and the open lever 32 rotates together with the outside handle lever 41 before the locking knob 53 is unlocked by the locking actuator 50, the slide bush 47 is placed to the arc shaped elongated hole 32*a* of the open lever 32. Thus, in the known device, the locking lever 37 is not rotated by the locking actuator 50 and an abnormal state, in which only the locking knob 53 of the door to be opened by the user remains locked, occurs.

That is, when the user is authenticated by using the portable unit (smart key) and then the switch 24 provided at the outside handle 23 is operated, the locking knobs 53 provided at all of the seats are brought into the unlocked state by the locking actuator 50 except the one which is disposed at the slide door 11 to be opened by the user to cause the above-described abnormal state, i.e. the so-called panic state. In this state, no matter how many times the operation are conducted, the locking knob 53 is not moved to the unlocked position and the slide door 11 is not opened. In order to defuse the situation, the doors of all seats need to be brought back to the locked state, and then the operation of the outside handle has to be operated again.

However, even if the user operates the outside handle 23 prematurely and the open lever 32 is rotated together with the outside handle lever 41 before the locking knob 53 is unlocked by the locking actuator 50, there is still a way that moves the locking knob 53 to the unlocked position to unlock the remote control unit 14.

Namely, when the outside handle 23 is operated before the locking knob 53 is unlocked by the locking actuator 50, as shown in FIG. 7, the outside handle lever 41 and the open lever 32 are rotated in a counter clockwise direction (direction indicated by the arrow B in FIG. 7) and thereby moving the slide bush 47 to the arc shaped elongated hole 32*a* of the open lever 32. The rotation of the first lever 43 of the locking lever 37 engaging with the slide bush 47 is restricted by placing the slide bush 47 in the arc shaped elongated hole 32*a*. However, the second lever 44, which is rotated by the locking actuator 50, is rotated relative to the first lever 43 against the biasing force of the torque spring 55 (biasing member) to reach the unlocked position. Thus, the second lever 44 is rotated to the unlocked position to move the locking knob 53 to the unlocked position.

Hence, once the user releases his/her hand from the outside handle 23, the outside handle lever 41 and the open lever 32 are returned to the original position by a restorative force of the tensile spring 61, and thus the slide bush 47 is placed in the recessed portion 32*b* of the open lever 32 again. At that time, the torque spring 55 (biasing member) generates the clockwise biasing force around the axial portion 44*a* and the biasing force constantly acts on the first lever 43. Thus, when the slide bush 47 is placed in the recessed portion 32*b* of the open lever 32, the biasing force of the torque spring 55 (biasing member), which acts on the first lever 43, rotates the first lever 43 until the engaging surface 43*c* of the first lever 43 engages with the engaging protrusion 44*c* of the second lever 44. Then, the slide bush 47 is inserted into the recessed portion 32*b* of the open lever 32 to engage therewith to unlock the remote control unit 14 (the state shown in FIG. 5). Thus, the locking knob 53 is moved to the unlocked position by the first handle operation. Thus, the outside handle 23 is again operated without pressing the switch 24 to rotate the outside handle lever 41 and the open lever 32. Consequently, the lift lever 33 is rotated via the slide bush 47 to release the latch unit 13.

Therefore, even if the outside handle lever 41 is rotated before the locking knob 53 is unlocked by the locking actuator 50, the locking knob 53 is moved to the unlocked position to prevent the occurrence of the panic state.

Meanwhile, when the outside handle 23 is operated to open the slide door 11 before the locking knob 53 is unlocked by the locking actuator 50, firstly, the outside handle lever 41 is rotated in the direction indicated by the arrow B as shown in FIG. 7. The engaging flange 41*a* (third engaging flange) engages with the engaging flange 32*d* (fourth engaging flange), and thus the open lever 32 is unitarily rotated with the outside handle lever 41 to move the slide bush 47 to the end portion of the arc shaped elongated hole 32*a* of the open lever 32. Thereafter, as shown in FIG. 7, the second lever 44 of the locking lever 37 is rotated in the direction indicated by an arrow A by the locking actuator 50. However, the rotation of the first lever 43 is restricted by the slide bush 47 engaging with the arc shaped elongated hole 32*a*, and the first lever 43 is not rotated to the unlocked position.

However, in the embodiment, the outside lever 35 is composed of the two components, i.e. the outside handle lever 41 and the release lever 42. As shown ill FIG. 8, the release lever 42 is rotated in a counter clockwise direction by the release actuator 19 which is operated having a time lag from the operation of the locking actuator 50, and the lift lever 33 is unitarily rotated with the release lever 42 around the coaxial shaft 45 in the clockwise direction via the engaging flanges 42*a* and 33*c* (first and second engaging flanges). Then, the latch unit 13 is released by the rotation of the lift lever 33 and the slide door 11 is manually opened.

When the main switch of the power slide door device 18 is on, as described above, if the user of the vehicle having the smart key approaches the area within the predetermined distance from the vehicle, the user is authenticated by the vehicle. In this state, the switch 24 provided at the outside handle 23 is operated for opening the slide door 11, the locking actuator 50 is operated in response to the operation of the switch 24 as well as the release actuator 19. The release lever 42 is rotated in the clockwise direction in FIGS. 3 and 5 by the operation of the release actuator 19. Consequently, the lift lever 33 is unitarily rotated with the release lever 42 around the coaxial shaft 45 in the clockwise direction via the engaging flanges 42*a* and 33*c* (first and second engaging flanges). Then, the latch unit 13 is released by the rotation of the lift lever 33, and the slide door 11 is automatically opened by the power slide door device 18.

At that time, since the locking actuator 50 is operated as well as the release actuator 19 and the second lever 44 of the locking lever 37 is rotated via the output lever 51. In this case, as described above, the lift lever 33 is rotated by the rotation of the release lever 42 and the open lever 32 is unitarily rotated with the lift lever 33 via the slide bush 47, with the slide bush 47 placed in the recessed portion 32*b* of the open lever 32.

Thus, the first lever 43 and the second lever 44, which compose the locking lever 37, do not rotate relative to each other against the torque spring 55 (biasing member), and the first lever 43 and the second lever 44 rotate unitarily maintaining the predetermined angle therebetween. Consequently, the slide bush 47 is placed in the recessed portion 32*b* of the open lever 32.

Even if the person who does not have the portable unit (smart key) operates the switch 24 of the outside handle 23 in the locked state of the slide door 11, the release actuator 19 and the locking actuator 50 are not operated. Thus, the remote control unit 14 remains locked. Further, even if the outside lever 35 is rotated by the operation of the outside handle 23 in the situation, the open lever 32 is rotated separately from the lift lever 33. Thus, the latch unit 13 is not operated to open the door.

When the locking knob 53 is moved to the locked position, the locking lever 37 is rotated in the counter clockwise direction in FIGS. 5 and 6 via the output lever 51 and the slide bush 47 is moved from the recessed portion 32*b* to the arc shaped elongated hole 32*a* of the open lever 32 to lock the slide door 11. At the time, even if the outside handle 32 or the inside handle (not shown) is operated, the open lever 32 is rotated separately from the lift lever 33. Thus, the latch unit 13 is not operated.

In the aforementioned embodiment, the outside lever 35 is composed of the two members, i.e. the outside handle lever 41 connected to the outside handle 23 and the release lever 42 connected to the lift lever 33 and operated by the release actuator 19. Thus, even if the outside handle 23 is operated before switching the slide door from the locked state to the unlocked state, for example, the passenger tries to get in the vehicle from the slide door 11 and prematurely operates the outside handle 23, the panic state is still avoidable. The lift lever 33 is independently rotated from the outside handle lever 41 by the release lever 42, which is operated by the release actuator 19. Therefore, the slide door 11 is properly opened.

According to the aforementioned embodiment, the outside handle lever 41 and the release lever 42 are coaxially supported so as to rotate relative to each other. Thus, the outside lever 35 composed of the two members is easily structured.

According to the aforementioned embodiment, the slide door device is composed of the power slide door device 18. When the switch of the power slide door device 18 is on, the release actuator 19 is operated by the communicating door opening and closing system. Thus, the slide door is not opened by operating the outside handle 23 unless the user having the portable unit (smart key) is authenticated.

According to the aforementioned embodiment, the lift lever 33, the open lever 32, the outside handle lever 41, and the release lever 42 are rotatably supported by the coaxial shaft 45 supported by the base bracket 31. Further, the release lever 42 has the engaging flange 42*a* (first engaging flange) which engages with the engaging flange 33*c* (second engaging flange) formed at the lift lever 33 to unitarily rotate the lift lever 33 with the release lever 42 when the release lever 42 is rotated by the release actuator 19. Thus, when the main switch of the power slide door device 18 is on, regardless of whether the locking knob 53 is in the locked state or in the unlocked state, the lift lever 33 is directly operated by the release lever 42 to operate the latch unit 13.

According to the aforementioned embodiment, the outside handle lever 41 of the outside lever 35 has the engaging flange 41*a* (third engaging flange) which engages with the engaging flange 32*d* (fourth engaging flange) formed at the open lever 32 to unitarily rotate the open lever 32 with the outside handle lever 41. Thus, even if the main switch of the power slide door device 18 is off, the lift lever 33 is operated by the outside handle 23 via the open lever 32 to manually open the slide door 11.

In the aforementioned embodiment, the opening and closing operation of the slidable slide door 11 is described as an example. However, the technology of the embodiment may be applied to a swing type vehicle door, and is not limited to the slide door 11. Further, the power slide door device 18 is not always essential.

Further, in the aforementioned embodiment, the locking knob 53 is slid between the locked position and the unlocked position. However, the locking knob 53 may be swung between the locked position and the unlocked position.

The application of the technology is not limited to the aforementioned embodiment, and various types of modifications may be made without departing from the spirit or scope of the invention stated in claims.

According to the aforementioned embodiment, in order to resolve the issue previously stated, the door opening and closing apparatus for the vehicle 10 includes the latch unit 13 holding the vehicle door in the closed state relative to the vehicle body 12, the lift lever 33 connected to the latch unit 13 to operate the latch unit 13, the open lever 32 operatively connected to the lift lever 33, the outside lever 35 connected to the outside handle 35 provided at the vehicle door, the locking lever 37 switching the locking knob 53 between the locked stated and the unlocked state and including the first lever 43 connected to the open lever 32 and the second lever 44 connected to the first lever 43 for relative rotation with the predetermined angle and operated by the locking actuator 50, and the torque spring 55 (biasing member) disposed between the first lever 43 and the second lever 44 to bias the second lever 44 in a direction of an original position where the second lever 44 is placed before rotating relative to the first lever 43, wherein the outside lever 35 is composed of two members, which are the outside handle lever 41 connected to the outside handle 23 and the release lever 42 connected to the lift lever 33 and operated by the release actuator 19. Thus, even if the outside handle 23 is operated before the vehicle door is switched from the locked state to the unlocked state, the panic state is avoided. The lift lever 33 is operated independently from the outside handle lever 23 by the release lever 42 operated by the release actuator 19, and thus the vehicle door is properly opened.

According to the aforementioned embodiment, the outside handle lever 16 and the release lever 42 are coaxially supported so as to be rotatable relative to each other. Thus, the outside lever 35, which is composed of the two members, is simply structured.

According to the aforementioned embodiment, the door opening and closing apparatus for the vehicle includes the slide door device having the slidable slide door 11. Thus, when the outside handle 23 is operated before the vehicle door is switched from the locked state to the unlocked state, for example, when the passenger tries to get in the vehicle from the rear slide door and operates the door handle 23 prematurely, the panic state is avoidable and the slide door 11 is properly opened.

According to the aforementioned embodiment, the slide door device is composed of the power slide door device 18, and the release actuator 19 is operated by the communicating door opening and closing system when the power slide door device 18 is switched on. Therefore, the slide door 11 is not opened unless the user having the portable unit (smart key) is authenticated.

According to the aforementioned embodiment, the lift lever 33, the open lever 32, the outside handle lever 41, and the release lever 42 are rotatably supported by the coaxial shaft 45 supported by the base bracket 31, and the release lever 42 has the engaging flange 42*a* (first engaging flange) engaging with the engaging flange 33*c* (second engaging flange) formed at the lift lever 33 for unitarily rotating the lift lever 33 therewith when the release lever 42 is rotated by the release actuator 19. For example, in the case that the switch of the power slide door device 18 is on, regardless of whether or not the locking knob 53 is in the locked state, the lift lever 33 may be directly operated by the release lever 42 to operate the latch unit 13.

According to the aforementioned embodiment, the outside handle lever 41 of the outside handle 23 has the engaging flange 41*a* (third engaging flange) engaging with the fourth engaging flange 32*d* (fourth engaging flange) formed at the open lever 32 for unitarily rotating the open lever 32 therewith when the outside handle lever 41 is rotated by the outside handle 23.

The principles, of the preferred embodiments and mode of operation of the present invention have been described in the foregoing specification. However, the invention, which is intended to be protected, is not to be construed as limited to the particular embodiment disclosed. Further, the embodiment described herein are to be regarded as illustrative rather than restrictive. Variations and changes may be made by others, and equivalents employed, without departing from the spirit of the present invention. Accordingly, it is expressly intended that all such variations, changes and equivalents that fall within the spirit and scope of the present invention as defined in the claims, be embraced thereby.

The invention claimed is:

1. A door opening and closing apparatus for a vehicle, comprising:

a latch unit holding a vehicle door in a closed state relative to a vehicle body, the latch unit comprising a latch engageable with a striker of the vehicle;

a lift lever connected to a cable and the cable connected to the latch unit so that the lift lever is connected to the latch unit to effect operation of the latch unit permitting the vehicle door to be moved towards an open state;

an open lever operatively connected to the lift lever;

a locking lever switching a locking knob between a locked state and an unlocked state, the locking lever including a first lever connected to the open lever and a second lever connected to the first lever for relative rotation with a predetermined angle, the second lever operated by a locking actuator;

a biasing member disposed between the first lever and the second lever to bias the first lever in a direction of an original position where the first lever is placed before rotating relative to the second lever;

an outside handle lever connected to an outside handle and operatively connected to the open lever; and a release lever connected to the lift lever and operated by a release actuator to operate the lift lever so as to effect said operation of the latch unit.

2. A door opening and closing apparatus for a vehicle according to claim 1, wherein the outside handle lever and the release lever are coaxially supported so as to be rotatable relative to each other.

3. A door opening and closing apparatus for a vehicle according to claim 1, further comprising:

a slide door device, wherein the vehicle door is a slidable slide door included in the slide door device.

4. A door opening and closing apparatus for a vehicle according to claim 3, wherein the slide door device is composed of a power slide door device, and the release actuator is operated by a communicating door opening and closing system when the power slide door device is switched on.

5. A door opening and closing apparatus for a vehicle according to claim 1, wherein the lift lever, the open lever, the outside handle lever, and the release lever are rotatably supported by a common coaxial shaft supported by a base bracket, and the release lever has a first engaging flange engaging with a second engaging flange formed at the lift lever for unitarily rotating the lift lever with the release lever when the release lever is rotated by the release actuator.

6. A door opening and closing apparatus for a vehicle according to claim 5, wherein the outside handle lever has a third engaging flange engaging with a fourth engaging flange formed at the open lever for unitarily rotating the open lever with the outside handle lever when the outside handle lever is rotated by the outside handle.

7. A door opening and closing apparatus for a vehicle according to claim 1, wherein the release lever directly engages the lift lever.

8. A door opening and closing apparatus for a vehicle according to claim 1, wherein the release lever is operated by the release actuator independently from the outside handle lever to operate the lift lever directly so as to effect said operation of the latch unit regardless of whether the door opening and closing apparatus is in the unlocked state.

9. A door opening and closing apparatus for a vehicle according to claim 1, wherein the release lever directly engages the lift lever and is operated by the release actuator independently from the outside handle lever to operate the lift lever so as to effect said operation of the latch unit regardless of whether the first lever is in the unlocked state.

10. A door opening and closing apparatus for a vehicle according to claim 1, wherein the latch unit comprises a latch adapted to engage a striker, and the lift lever is connected to the latch unit by a cable.

11. A door opening and closing apparatus for a vehicle, comprising:

a latch unit holding a vehicle door in a closed state relative to a vehicle body, the latch unit comprising a latch engageable with a striker of the vehicle;

a lift lever connected to the latch unit to effect operation of the latch unit permitting the vehicle door to be moved towards an open state;

an open lever operatively connected to the lift lever;

an outside handle lever connected to an outside handle and operatively connected to the open lever;

a release lever connected to the lift lever and being operated by a release actuator to operate the lift lever so as to effect said operation of the latch unit; and the lift lever, the open lever, the outside handle lever and the release lever being rotatably supported on a common coaxial shaft.

12. A door opening and closing apparatus for a vehicle according to claim 11, wherein the release lever directly engages the lift lever.

13. A door opening and closing apparatus for a vehicle according to claim 11, wherein the release lever is operated by the release actuator independently from the outside handle lever to operate the lift lever directly so as to effect said operation of the latch unit regardless of whether the door opening and closing apparatus is in the unlocked state.

14. A door opening and closing apparatus for a vehicle according to claim 11, wherein the release lever is separate from the outside handle lever, the release lever being operated independent of operation of the outside handle lever by the release actuator to operate the lift lever so as to effect said operation of the latch unit.

15. A door opening and closing apparatus for a vehicle according to claim 11, wherein the latch unit comprises a latch adapted to engage a striker, and the lift lever is connected to the latch unit by a cable.

16. A door opening and closing apparatus for a vehicle comprising:

a latch unit holding a vehicle door in a closed state relative to a vehicle body, the latch unit comprising a latch engageable with a striker of the vehicle;

a lift lever connected to the latch unit to effect operation of the latch unit to permit the vehicle door to be moved to an open state;

an open lever operatively connected to the lift lever;

a locking lever switching a locking knob between a locked state and an unlocked state, the locking lever including a first lever connected to the open lever and a second lever connected to the first lever for relative rotation with a predetermined angle, the second lever operated by a locking actuator;

a biasing member disposed between the first lever and the second lever to bias the first lever in a direction of an original position where the first lever is placed before rotating relative to the second lever;

an outside handle lever connected to an outside handle and operatively connected to the open lever;

a release lever separate from the outside handle lever and connected to the lift lever, the release lever being operated independent of operation of the outside handle lever by a release actuator to operate the lift lever so as to effect said operation of the latch unit;

the lift lever and the open lever each being provided with a respective through slot; and a common bush positioned in the slot of the lift lever and in the slot of the open lever so that in the unlocked state, rotation of the open lever causes rotation of the lift lever.

17. A door opening and closing apparatus for a vehicle according to claim 16, wherein the latch unit comprises a latch adapted to engage a striker, and the lift lever is connected to the latch unit by a cable.

* * * * *